United States Patent [19]

Pedersen

[11] Patent Number: 5,006,296

[45] Date of Patent: Apr. 9, 1991

[54] PROCESS FOR THE PREPARATION OF FIBERS OF STEREOREGULAR POLYSTYRENE

[75] Inventor: David R. Pedersen, Clayton, Calif.

[73] Assignee: The Dow Chemical Company, Midland, Mich.

[21] Appl. No.: 239,490

[22] Filed: Sep. 1, 1988

[51] Int. Cl.[5] ..... D01F 6/22

[52] U.S. Cl. ..... 264/210.7; 264/176.1; 264/210.8; 264/211.14; 264/211.15

[58] Field of Search ..... 210/500.34; 526/138, 526/159, 160; 264/176.1, 210.8, 210.7, 211.14, 211.15

[56] References Cited

U.S. PATENT DOCUMENTS

| | | | |
|---|---|---|---|
| 2,988,783 | 6/1961 | Miller et al. | 18/48 |
| 3,019,077 | 1/1962 | Carey et al. | 18/54 |
| 3,069,406 | 12/1962 | Newman et al. | 260/93.5 |
| 3,078,139 | 2/1963 | Brown et al. | 18/54 |
| 3,092,891 | 6/1963 | Baratti | 28/82 |
| 3,342,920 | 9/1967 | Fukushima et al. | 264/184 |
| 4,356,138 | 10/1982 | Kavesh | 264/184 |
| 4,403,012 | 9/1983 | Harpell et al. | 428/290 |
| 4,403,069 | 9/1983 | Keller et al. | 525/197 |
| 4,413,110 | 11/1983 | Kavesh et al. | 264/205 |
| 4,455,273 | 6/1984 | Harpell et al. | 264/184 |
| 4,457,985 | 7/1984 | Harpell et al. | 428/224 |
| 4,536,536 | 8/1985 | Kavesh et al. | 264/184 |
| 4,551,296 | 11/1985 | Kavesh et al. | 264/184 |
| 4,680,353 | 7/1987 | Ishihara et al. | 526/347 |

FOREIGN PATENT DOCUMENTS

| | | |
|---|---|---|
| 1102944 | 6/1981 | Canada . |
| 291915 | 11/1988 | European Pat. Off. . |
| 5514163 | 4/1980 | Japan . |

OTHER PUBLICATIONS

Le Candia et al., "Solvent-Induced Crystallization of Glossy Syndiotactic Polystyrene", Makronol Chem., Rapid Commun. 9, 765–769 (1988).

Immirzi et al., "Solvent-Induced polymorphism in syndiotactic polystyrene", Makronol. Chem, Rapid Commun, 9, 761–764 (1988).

Enclyclopedia of Polymer Science and Engineering, vol. 15, John Wiley & Sons, NY, p. 657.

*Primary Examiner*—Hubert C. Lorin

[57] ABSTRACT

A process for the preparation of fibers of syndiotatic polystyrene, or a mixture of isotactic polystyrene and syndiotactic polystyrene which comprises:

A. heating syndiotactic polystyrene, or a mixture of syndiotactic polystyrene and isotactic polystyrene, to a temperature between its crystal melting point and the temperature at which the polystyrene undergoes degradation, wherein the polystyrene has sufficient viscosity to be extruded:

B. extruding the polystyrene through an orifice to form a fiber at elevated temperature;

C. quenching the fiber by passing the fiber through one or more zones under conditions such that the fiber solidifies; and D. cooling the fiber to ambient temperature.

10 Claims, No Drawings

PROCESS FOR THE PREPARATION OF FIBERS OF STEREOREGULAR POLYSTYRENE

BACKGROUND OF INVENTION

This invention relates to a process for the preparation of fibers of stereoregular polystyrene, in particular isotactic and syndiotactic polystyrene.

In many industries there is a drive to replace the metals used as structural materials with plastic materials. Plastic materials offer several advantages in that they are frequently lighter, do not interfere with magnetic or electrical signals, and often are cheaper than metals. One major disadvantage of plastic materials is that they are significantly weaker than many metals. To provide plastic structural articles and parts which have sufficient strength for the intended use, it is common to use composite materials which comprise a polymer or plastic matrix with high strength fibers in the plastic or polymer matrix to provide enhanced strength. Examples of composites made using such high strength fibers can be found in Harpell et al. U.S. Pat. No. 4,457,985 and Harpell et al. U.S. Pat. No. 4,403,012.

A series of patents have recently issued which relate to high strength fibers of polyethylene, polypropylene or co-polymers of polyethylene and polypropylene. Such fibers are demonstrated as being useful in high strength composites. See Harpell et al. U.S. Pat. No. 4,563,392; Kavesh et al. U.S. Pat. No. 4,551,296; Harpell et al. U.S. Pat. No. 4,543,286: Kavesh et al. U.S. Pat. No. 4,536,536: Kavesh et al. U.S. Pat. No. 4,413,110: Harpell et al. U.S. Pat. No. 4,455,273; and Kavesh et al. U.S. Pat. No. 4,356,138. Other polymers which have been used to prepare fibers for composites include polyphenylene sulfide, polyetheretherketone and poly(paraphenylene benzobisthiazole).

The polyethylene and polypropylene fibers although exhibiting excellent modulus and tensile properties, have a relatively low heat distortion temperature and poor solvent resistance. The polyphenylene sulfide, polyetheretherketone, and poly(p-phenylene benzobisthiazole) polymers exhibit excellent heat distortion temperatures and solvent resistance, but are difficult to process and quite expensive.

What are needed are fibers useful in composites which exhibit good solvent resistance and heat distortion properties, are processible, and prepared from materials which have reasonable costs. What are further needed are such fibers with high strength. What is further needed is a process for the preparation of such fibers.

SUMMARY OF INVENTION

The invention is a process for the preparation of fibers of syndiotactic polystyrene, or a mixture of isotactic polystyrene and syndiotactic polystyrene which comprises:

A. heating syndiotactic polystyrene, or a mixture of syndiotactic polystyrene and isotactic polystyrene, to a temperature between its crystal melting point and the temperature at which the polystyrene undergoes degradation, wherein the polystyrene has sufficient viscosity to be extruded;

B. extruding the polystyrene through an orifice to form a fiber at elevated temperatures;

C. quenching the fiber by passing the fiber through one or more zones under conditions such that the fiber solidifies; and D. cooling the fiber to ambient temperature.

Preferably the fibers prepared are high strength fibers of syndiotactic polystyrene, or a mixture of isotactic polystyrene and syndiotactic polystyrene, wherein the fibers are monoaxially oriented, have a tensile strength of about 10,000 psi or greater, and a modulus of about 1,000,000 psi or greater.

To prepare high strength fibers, the fibers are further exposed to the following process steps:

E. heating the fiber to a temperature above the glass transition temperature of the polystyrene: and F. redrawing the fiber to elongate the fiber, maximize crystallinity, and induce monoaxial orientation of the polystyrene in the fiber.

The fibers prepared by the process of this invention exhibit excellent solvent resistance and heat distortion properties. The starting materials used to prepare these fibers can be prepared at a relatively low cost.

DETAILED DESCRIPTION OF THE INVENTION

The fibers of this invention may be prepared from syndiotactic polystyrene or a mixture of syndiotactic and isotactic polystyrene. Syndiotactic polystyrene is polystyrene in which the phenyl groups pendent from the chain alternate with respect to which side of the chain the phenyl groups are pendent. In other words, every other phenyl group is on the opposite side of the chain. Isotactic polystyrene has all of the phenyl rings on the same side of the chain. Note that standard polystyrene is referred to as atactic, meaning it has no stereoregularity, and the placement of the phenyl groups from the styrene with respect to each side of the chain is random, irregular, and follows no pattern.

Preferably, the fibers prepared by this invention are monoaxially oriented to improve the tensile strength and modulus of the fibers. Preferably the fibers have a tensile strength of 10,000 psi or greater, more preferably 20,000 psi or greater and most preferably 30,000 psi or greater. The fibers of this invention preferably have a modulus of 1,000,000 psi or greater, more preferably 2,500,000 psi or greater, and most preferably 5,000,000 psi or greater. The fibers may be extruded into any size, shape or length desired. Preferably the fibers have a heat distortion temperature of 150° C. or greater, more preferably 170° C. or greater and most preferably 190° C. or greater. Preferably the fibers have a crystalline melting temperature of 200° C. or greater, more preferably 220° C. or greater, and most preferably 240° C. or greater.

Isotactic and syndiotactic polystyrene may be prepared by methods well known in the art. For procedures for the preparation of isotactic polystyrene, see Natta et al., Makromol. Chem., Vol. 28, p. 253 (1958) (relevant portions incorporated herein) by reference. For procedures for the preparation of syndiotactic polystyrene, see Japanese Patent 104818 (1987) and Ishihara, *Makromolecules,* 19 (9), 2464 (1986) relevant portions incorporated herein by reference.

If the viscosity of the heated polystyrene fed to the extruder is too low the fibers coming out of the extruder will have no physical integrity, and if the viscosity is too high the mixture is not extrudable. Preferably the polystyrene has an upper limit on viscosity at the extrusion sheer rate of 1,000,000 poise, more preferably 500,000 poise and most preferably 100,000 poise. Preferably the polystyrene has a lower limit on viscosity at the extrusion sheer rate of 100 poise, more preferably 1,000 poise and most preferably 10,000 poise.

The polystyrene molecular weight should be sufficient such that fibers with reasonable integrity may be formed. The preferred upper limit on molecular weight (Mn) is 4,000,000, with 3,000,000 being more preferred, and 1,000,000 being most preferred. The preferred lower limit on molecular weight (Mn) is 200,000, with 300,000 being more preferred and 400,000 most preferred.

Where a fiber is to be prepared from both syndiotactic polystyrene and isotactic polystyrene the ratio of syndiotactic polystyrene to isotactic polystyrene in the blend is any ratio which gives fiber with structural integrity and is preferably between about 0.1 and 20, more preferably between about 0.75 and 3, most preferably between about 1 and 1.25.

In the process of this invention, the neat polymer is heated to a temperature between its crystal melting point and the temperature at which the polymer undergoes degradation. The particular temperature depends upon whether syndiotactic polystyrene or a mixture of isotactic and syndiotactic polystyrene is used. Generally the crystal melting temperature of isotactic polystyrene is somewhat lower than that of syndiotactic polystyrene. The neat polymer is first melted to a temperature at which the material has sufficient viscosity to extrude. The viscosity should be high enough such that the fiber extruded has integrity, yet not so high that the polymer is too viscous to be extruded. Preferably the polymer is melted to a temperature of between about 260 and 320, and most preferably between about 270° and about 300° C. Thereafter the fiber is extruded at such temperatures.

Once the polystyrene has been heated it is extruded through a die of a desired shape, usually a circular die, into the form of a fiber. The extrusion is performed at elevated temperatures, the upper limit on the temperature is the degradation temperature of the polystyrene. The lower limit on temperature is the lowest temperature at which the polystyrene has low enough viscosity to be extruded. Preferred extrusion temperatures are between about 260 and 320 with between about 270° and 300° C. most preferred. Thereafter the fiber is passed through a quench zone. The quench zone may be either a gaseous quench zone or a liquid quench zone.

From the extruder the fiber is passed through one or more quench zones. Such quench zones may be gaseous quench zones, liquid quench zones or a combination thereof. In the quench zones the fiber is cooled, solidified and drawn down. In a quench zone the fiber is passed through a gaseous zone, such zone may be at a temperature of between 0° and 100° C., preferably the temperature is ambient temperature. The preferred gas is air. For a melt extrusion generally an air quench zone is preferred. The air quench zone is generally long enough to quench and solidify the fiber. Such zone is preferably between about 1 and 6 feet. The temperature of the quench zone can be any temperature at which the fiber undergoes a reasonable rate of cooling and solidification. The preferred lower temperature is about 0°, most preferably about 20°. The preferred upper temperature is about 100° C., most preferably about 50° C.

The liquid which may be used for the liquid quench is a liquid which does not dissolve the polystyrene. Preferred quench zone materials include water, lower alcohols, halogenated hydrocarbons, and perhalogenated carbon compounds. Perhalogenated carbon compounds are materials with a carbon backbone wherein all of the hydrogen atoms have been replaced with halogen atoms. The most preferred liquid quench material is water. The lower limit on the temperature of a liquid quench zone is that temperature at which the quench material freezes. The upper limit on the temperature of a liquid quench zone is that temperature above which the fiber does not undergo solidification when in contact with the quench material or the quench material boils. Preferably the upper limit on temperature is 80° and more preferably 30° C. Preferably the lower limit on temperature is 0° C. The residence time of the fiber in a quench zone is preferably greater or equal to 0.5 seconds, more preferably between about 0.5 and 10 seconds.

During the quench period the fiber is also drawn down. Preferably the lower limit on the draw down is from about 10:1, more preferably about 50:1. Preferably the upper limit on the draw down is about 100:1. Drawing down means the fibers are stretched such that the cross sectional area of the fiber is smaller at the end of the process and the draw down ratio is the ratio of the beginning cross sectional area to the final cross sectional area. During the quench period the fiber is drawn down from between about 10:1 to 100:1. After the quench period, the fiber is allowed to cool to ambient temperatures.

When it is desired to improve the strength of the fiber, the fiber is reheated to a temperature at which the fiber can be redrawn. It is in the redraw process that the fiber is oriented such that the fiber has monoaxial orientation. The fiber is heated to a temperature between its glass transition temperature and its melting point. Preferable upper temperatures are 280° C. or below and more preferably 270° C. or below. Preferable lower temperatures are 150° C. or above and more preferably 250° C. or above. Thereafter the fiber is redrawn by stretching the fiber with tension: this is usually performed by running the fibers over a set of godets wherein the latter godets are going at a much faster rate than the earlier godets. The fiber is elongated at a ratio of between about 1.5:1 and about 10:1. Preferably the rate of elongation is 1 foot per minute or less. The redraw occurs while the fiber is at or near the temperature to which it was preheated. The fiber may be drawn in one or more stages with the options of using different temperatures, draw rates, and draw ratios in each stage. The slower the rate the better the orientation and stronger the fiber will be. Generally the elongation will be up to a ratio of 4 to 1.

The fibers can be incorporated into composites. The methods for such incorporation and the composites in which the fibers can be used in are well known to those skilled in the art.

SPECIFIC EMBODIMENTS

The following examples are included for illustrative purposes only and are not intended to limit the scope of the invention or the claims. Unless otherwise stated all parts and percentages are by weight.

EXAMPLE 1

Syndiotactic polystyrene, with a molecular weight of 300,000 $M_w$, is placed in the heating zone of an extruder and heated to 250° C. The polystyrene is extruded at 250° C. through a 1.0 mm diameter spinnerette into an air quench zone, the zone having a length of 5 feet. The residence time in the quench zone is 3 seconds. The fiber after quenching is taken up and allowed to cool to ambient temperature. The fiber exhibits a tensile strength of 15,000 psi, and a modulus of 1,200,000 psi with a final elongation of 5.6%.

EXAMPLE 2

Syndiotactic polystyrene, with a molecular weight of 700,000 $M_w$, is placed in the heating zone of an extruder and heated to 260° C. The polystyrene is extruded at 260° C. through a 1.0 mm diameter spinnerette into an air quench zone, the zone having a length of 5 feet. The residence time in the quench zone is 3 seconds. The fiber after quenching is taken up and allowed to cool to ambient temperature. The fiber is redrawn 100% at 180° C. The fiber exhibits a tensile strength of 19,000 psi, and a modulus of 830,000 psi with a final elongation of 4.1%.

EXAMPLE 3

Syndiotactic polystyrene, with a molecular weight of 700,000 $M_w$, is placed in the heating zone of an extruder and heated to 260° C. The polystyrene is extruded at 260° C. through a 1.0 mm diameter spinnerette into an air quench zone, the zone having a length of 5 feet. The residence time in the quench zone is 3 seconds. The fiber after quenching is taken up and allowed to cool to ambient temperature. The fiber is redrawn 160% at 280° C. The fiber exhibits a tensile strength of 15,000 psi, and a modulus of 950,000 psi with a final elongation of 3.9%.

EXAMPLE 4

Syndiotactic polystyrene, with a molecular weight of 800,000 $M_w$, is placed in the heating zone of an extruder and heated to 275° C. The polystyrene is extruded at 275° C. through a 1.0 mm diameter spinnerette into an air quench zone, the zone having a length of 5 feet. The residence time in the quench zone is 3 seconds. The fiber after quenching is taken up and allowed to cool to ambient temperature. The fiber exhibits a tensile strength of 10,000 psi, and a modulus of 410,000 psi with a final elongation of 3.7%.

EXAMPLE 5

Syndiotactic polystyrene, with a molecular weight of 800,000 $M_w$, is placed in the heating zone of an extruder and heated to 275° C. The polystyrene is extruded at 275° C. through a 1.0 mm diameter spinnerette into an air quench zone, the zone having a length of 5 feet. The residence time in the quench zone is 3 seconds. The fiber after quenching is taken up and allowed to cool to ambient temperature. The fiber is redrawn 50% at 280° C. The fiber exhibits a tensile strength of 8,000 psi, and a modulus of 470,000 psi with a final elongation of 2.1%.

EXAMPLE 6

Syndiotactic polystyrene, with a molecular weight of 3,000,000 $M_w$, is placed in the heating zone of an extruder and heated to 300° C. The polystyrene is extruded at 300° C. through a 1.0 mm diameter spinnerette into an air quench zone, the zone having a length of 5 feet. The residence time in the quench zone is 3 seconds. The fiber after quenching is taken up and allowed to cool to ambient temperature. The fiber exhibits a tensile strength of 12,000 psi, and a modulus of 450,000 psi with a final elongation of 6.3%.

EXAMPLE 7

Syndiotactic polystyrene, with a molecular weight of 3,000,000 $M_w$, is placed in the heating zone of an extruder and heated to 300° C. The polystyrene is extruded at 300° C. through a 1.0 mm diameter spinnerette into an air quench zone, the zone having a length of 5 feet. The residence time in the quench zone is 3 seconds. The fiber after quenching is taken up and allowed to cool to ambient temperature. The fiber is redrawn 50% at 280° C. The fiber exhibits a tensile strength of 14,000 psi, and a modulus of 700,000 psi with a final elongation of 3.8%.

What is claimed is:

1. A process for the preparation of fibers of syndiotactic polystyrene, or a mixture of syndiotactic polystyrene and isotactic polystyrene which comprises:

A. heating syndiotactic polystyrene, or a mixture of syndiotactic polystyrene and isotactic polystyrene, to a temperature between its crystal melting point and the temperature at which the polystyrene undergoes degradation, wherein the polystyrene has sufficient viscosity to be extruded;

B. extruding the polystyrene through an orifice to form a fiber at elevated temperatures:

C. quenching the fiber by passing the fiber through one or more zones under conditions such that the fiber solidifies; and D. cooling the fiber to ambient temperature.

2. A process for the preparation of high strength fibers of syndiotactic polystyrene, or a mixture of syndiotactic polystyrene and isotactic polystyrene which comprises:

A. heating syndiotactic polystyrene, or a mixture of syndiotactic polystyrene and isotactic polystyrene, to a temperature between its crystal melting point and the temperature at which the polystyrene undergoes degradation, wherein the polystyrene has sufficient viscosity to be extruded;

B. extruding the solution through an orifice to form a fiber at elevated temperatures;

C. quenching the fiber by passing the fiber through one or more zones under conditions such that the fiber solidifies:

D. cooling the fiber to ambient temperature;

E. heating the fiber to a temperature above the glass transition temperature of the polystyrene;

F. redrawing the fiber to elongate the fiber and induce monoaxial orientation of the polystyrene in the fiber.

3. The process of claim 2 wherein the fiber is quenched by passing the fiber through an air zone.

4. The process of claim 3 wherein the polystyrene is heated prior to extrusion to, and extruded at, a temperature of between about 260° and about 320° C.

5. The process of claim 4 wherein the temperature of the air quench zone is between about 0° and about 100° C.

6. The process of claim 5 wherein the fiber is drawn down in the air quench zone at a ratio of between about 10:1 and about 100:1.

7. The process of claim 6 wherein the fiber is heated for redraw to a temperature of between about 150° and about 280° C.

8. The process of claim 7 wherein the fiber is redrawn to an elongation ratio of between about 1.5:1 and about 10:1.

9. The process of claim 8 wherein the fiber has a tensile strength of about 10,000 psi or greater.

10. The process of claim 9 wherein the fiber has a modulus of about 1,000,000 psi or greater.

* * * * *